United States Patent [19]

Bennett

[11] 4,061,463

[45] Dec. 6, 1977

[54] COMBUSTION SYSTEM AND METHOD

[75] Inventor: Henry J. Bennett, Palos Park, Ill.

[73] Assignee: Burdett Manufacturing Company, Bridgeview, Ill.

[21] Appl. No.: 640,260

[22] Filed: Dec. 12, 1975

[51] Int. Cl.[2] ..... F23M 9/06

[52] U.S. Cl. ..... 431/9; 431/11; 431/116; 431/161

[58] Field of Search ..... 431/9, 115, 116, 285, 431/11, 161

[56] References Cited

U.S. PATENT DOCUMENTS

| | | | |
|---|---|---|---|
| 2,688,360 | 9/1954 | Haynes et al. | 431/115 |
| 3,146,821 | 9/1964 | Wuetig | 431/115 |
| 3,361,183 | 1/1968 | Reichhelm | 431/116 |
| 3,620,657 | 11/1971 | Robinson | 431/9 |
| 3,705,784 | 12/1972 | Reichhelm et al. | 431/116 |

*Primary Examiner*—Edward G. Favors

*Attorney, Agent, or Firm*—Allegretti, Newitt, Witcoff & McAndrews

[57] ABSTRACT

A combustion system and method for liquid fuels includes atomizing the liquid fuel, withdrawing heated air from an enclosure which is to be heated by the fuel, contacting the atomized liquid fuel with the heated air which is at a temperature sufficient to instantaneously vaporize the fuel and in a quantity sufficient to form a combustible mixture with the vaporized fuel, and burning the combustible mixture to heat the enclosure. In addition, a dual fuel system is disclosed which is capable of using either the aforementioned liquid fuel system and method or a natural gas combustible mixture.

13 Claims, 1 Drawing Figure

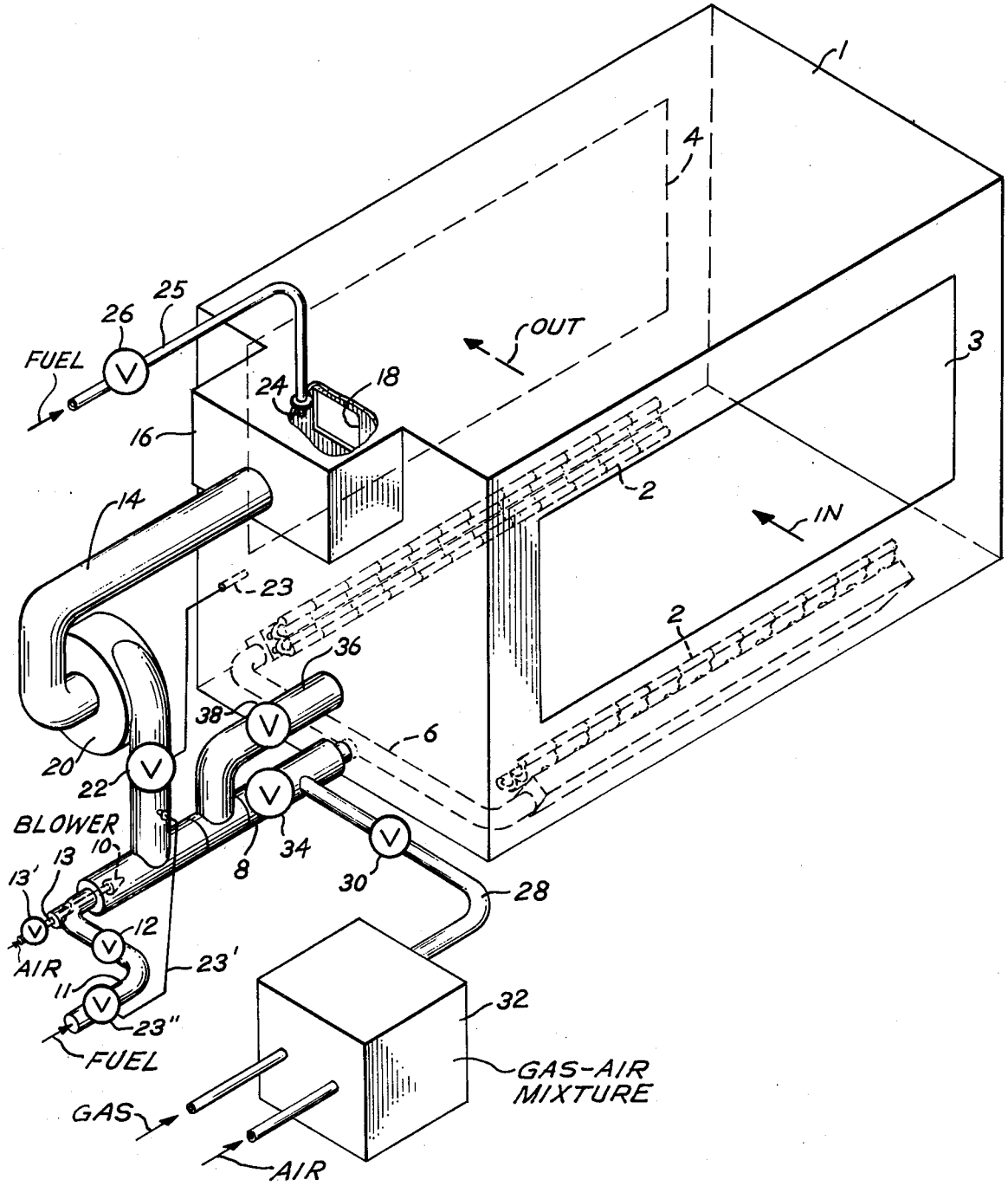
1
4
OUT
3
25
26
FUEL
24
18
16
2
IN
14
23
2
36
38
6
20
22
BLOWER
10
13
13'
8
34
30
28
12
AIR
23'
11
32
23"
FUEL
GAS-AIR
MIXTURE
GAS
AIR

COMBUSTION SYSTEM AND METHOD

BACKGROUND OF THE INVENTION

This invention relates to a combustion system and method and, more particularly, to a combustion system and method utilizing heated air from an enclosure which is to be heated to form a combustible mixture for heating the enclosure.

Both liquid and gaseous fuel systems are widely used in industry for the heating of processing chambers, such as drying and curing ovens. These systems generally fall into one of two broad categories. One category includes the nozzle mixing systems in which the fuel is introduced through the burner tip where it is then mixed at the burner with air supplied from a separate source, such as a blower, to form a combustible mixture which ignites at the burner. The second category is the premix type of system in which a combustible mixture of air or other oxidizing gas is mixed with the fuel before reaching the burner and this mixture is pressurized and discharged from the burner where it ignites. Burners such as infrared burners are within the last category, as is the present invention.

Several premix systems have been employed in the past which utilize liquid fuels, such as No. 1 and No. 2 fuel oils. One such system includes an oil superheating device which includes a tank having liquid fuel oil therein. An auxiliary burner is located in the tank to heat the oil and form oil vapors. The vapors are drawn from the tank by a Venturi or other vacuum mixing device and cold air, at ambient room temperature, is blown through the Venturi where the vaporized oil and air are mixed to form the combustible mixture. This mixture is then conducted to the burners where it is burned.

That system suffers several disadvantages. One disadvantage is that the room temperature air in the combustible mixture consumes sensible heat upon ignition of the mixture, thus resulting in low efficiency and economy. Another disadvantage is that the system is cumbersome and requires the provision of substantial quantities of auxiliary equipment which is both expensive and space consuming. Another significant disadvantage is that of safety, since the auxiliary burners which are employed to heat the oil to vaporize it always present the possibility of explosion of the vapors. In addition, since the vapors are mixed with air which is only at ambient temperature, condensation of the oil may occur in the piping and at the burners which produces soot. Such soot requires frequent cleaning, reduces efficiency and may damage the articles being treated in the oven. Moreover, the condensation of the oil prevents the use of infrared burners which are only operable with gaseous fuels and frequently necessitates a change of burners where both liquid and gaseous fuels must be used on different occasions.

Another system employs an air heating chamber which also contains an auxiliary burner. Air at ambient room temperature is injected under pressure into the air heating chamber where its temperature is elevated by the auxiliary burner to a temperature substantially in excess of the dew point of the liquid fuel. This heated air is then brought into contact with atomized liquid fuel to vaporize the fuel and form a combustible mixture which is burned at the burners.

Although the latter system, to a major extent, solves the safety and condensation and sooting problems encountered in the first described system, it is essentially still as uneconomical, cumbersome and space consuming as the first described system. In addition, special burners are needed in the air heating chamber because of the elevated pressures in that chamber.

Systems have also been employed in the past in an attempt to improve economy. These systems, by and large, have utilized economizers or heat exchangers for transferring some of the sensible heat from the flue gases escaping from the oven or enclosure to the air which forms the combustible mixture. Although such economizers or heat exchangers do improve the economy of the system, they are cumbersome, expensive, and space consuming.

The present invention overcomes each of the above mentioned disadvantages. The present invention is economical, not only from the standpoint of improved heat-to-fuel ratios, but also from the standpoint of reduced initial capital expenditure, reduction of auxiliary equipment and reduction in space comsumption. The present invention may be readily adapted to the dual use of alternate fuels of different kinds and phase states in the event that one of the fuels becomes unavailable and the need for shutdown or changing burners, such as infrared burners, which are otherwise not compatible with both gas and liquid fuels is avoided. The combustion system and method of the present invention are safe and minimize explosion hazard. Specially designed auxiliary burners need not be employed in the present invention, since the auxiliary burners need not discharge against a back-pressure. Finally, the present invention may be easily retrofited on existing installations.

In one principal aspect of the present invention, a combustion system which is adapted to heat an enclosure includes combustion burner means for supplying heat to the enclosure, conduit means connected to the burner means for supplying a combustible mixture of an oxidizing gas and a fuel to the burner means, injection means for discharging a finely atomized liquid fuel to the conduit means, second conduit means between the enclosure and the first conduit means for supplying heated oxidizing gas from the enclosure to the first conduit means adjacent the injection means, and control means for controlling the temperature and quantity of the oxidizing gas supplied from the enclosure such that the oxidizing gas vaporizes the liquid fuel atomized by the injection means and forms a combustible mixture.

In another principal aspect of the present invention, a method of heating an enclosure includes the steps of elevating the temperature of the enclosure, forming an atomized liquid fuel, removing a portion of an oxidizing gas from the heated enclosure, contacting the atomized liquid fuel with the heated oxidizing gas, controlling the quantity and temperature of the gas removed from the enclosure so as to form a combustible mixture with the fuel and vaporize the atomized liquid, and burning the mixture to heat the enclosure.

These and other objects, features and advantages of the present invention will be more clearly understood through a consideration of the following detailed description.

BRIEF DESCRIPTION OF THE DRAWING

In the course of this description, reference will frequently be made to the attached drawing in which the sole FIGURE is an overall schematic view of a combustion system and a system which employs the method incorporating the principles of the present invention.

DESCRIPTION OF THE PREFERRED EMBODIMENT

An overall schematic view is shown in the drawing of a preferred embodiment of combustion system and method which incorporates the principles of the present invention. The system and method of the present invention, as shown in the drawing, are utilized in the heating of an enclosure 1, such as an industrial processing chamber, drying or curing oven having premix burners 2 for heating the enclosure. The enclosure may include suitable entrance and exit apertures 3 and 4 through which articles to be treated are conveyed into and out of the enclosure by suitable conveyor means (not shown).

The burners may comprise one or more of a wide variety of premix burners, although infrared burners are preferred because of their cleanliness and efficiency. In addition, infrared burners are preferred, since liquid fuel flames such as fuel oil as contemplated in the present invention, are more susceptible to flame quenching than gas flames. Upon quenching, soot is produced which is detrimental to industrial finishes and other heating processes. Infrared burners minimize the possibility of flame quenching, since combustion occurs against an incandescent surface of the burner which is generally at a temperature of 1600° F to 2500° F, well above the quenching temperature.

The burners 2 are connected to a suitable manifold 6 through which a combustible mixture of fuel and an oxidizing gas, preferably air, is conducted to the burners.

A premix fuel assembly is positioned outside, but adjacent to, one of the walls of the enclosure. The premix assembly includes a first conduit 8 having a tee which communicates at one end with the manifold 6. One or more liquid fuel injection nozzles 10 are positioned in the other end of the conduit 8 and are connected, by a suitable fuel line 11 and shut off and balancing valve 12, to a source of liquid fuel supply (not shown) such as No. 1 or No. 2 fuel oil. In addition, a compressed air conduit 13 is preferably provided having shut off valve 13' which connects a source of compressed air (not shown) to the nozzle 10 to atomize the liquid fuel at the nozzle. Although the liquid fuel may be injected under pressure without air from conduit 13, the air-liquid nozzle is preferred because such nozzle is capable of producing a more uniform atomization over wide variations in fuel flow rates as ignition is varied to control the heat demands of enclosure 1.

A second conduit 14 is mounted so as to remove heated gases from the top of the enclosure 1 and introduce the heated gases to the liquid fuel which has been atomized by nozzles 10. Conduit 14 may either communicate directly with the enclosure 1 or, preferably, by way of an auxiliary chamber 16 as shown in the drawing. Chamber 16 opens to the top of enclosure 1 through an aperture 18 in the enclosure wall. A blower 20, preferably of the centrifugal, constant pressure delivery type, is located in condiut 14 so as to take suction on the chamber 16 and discharge the gases at a pressure of preferably about 16–32 osig to intimately mix the heated gases drawn from enclosure 1 with the atomized fuel.

It is the purpose of the present invention to form a pressurized combustible mixture for burning at the burners 2 by mixing the atomized liquid fuel injected through nozzle 10 with the hot gases from conduit 14. Thus, the gases from conduit 14 should be present, not only in a sufficient quantity to form the combustible mixture, but at a temperature sufficiently above the dew point of the atomized liquid fuel to insure instantaneous vaporization of the fuel, not only at the time of mixing, but at the time of discharge from the burners 2.

The quantity of gases passing through conduit 14 may be controlled in any well-known manner, such as by way of a suitable valve 22 between blower 20 and conduit 8. Valve 22 is preferably controlled by means of a temperature sensor 23 which senses the temperature in enclosure 1 and controls valve 22 to adjust the pressure and volume of hot gases delivered from blower 20 to conduit 8 in accordance with the heat demand of the enclosure. In turn, the fuel flow rate through nozzle 10 is adjusted in response to the pressure in conduit 14 between valve 22 and conduit 8 by a pressure transmitting conduit 23' which is connected to a flow control valve 23'' in the fuel line 11.

The dew point of No. 1 and No. 2 fuel oils is approximately 200°–300° F. Thus, the oxidizing gas, which is usually air, which is mixed with the atomized liquid fuel in conduit 8 should exceed that temperature and should preferably exceed 400° F to insure that the fuel will still be vaporized upon exit from the burners 2 to prevent any condensation of the fuel before it reaches the burners. If the temperature of the gases in the enclosure 1 will exceed 400° F during normal operation, auxiliary temperature elevating burners or the like in conduit 14 will be unnecessary during continuing operation. During initial heat-up, however, it is necessary to heat the gases passing through conduit 14, since the gases from the enclosure at light-off will be at room temperature only. For this purpose, an auxiliary burner 24 is positioned in the chamber 16 which may be used during light-off to elevate the temperature of the gases passing into conduit 14 to a temperature sufficiently above the dew point of the fuel being used to insure vaporization of the fuel. In the event that the normal operating temperatures in enclosure 1 do not exceed a temperature sufficient to insure that the dew point of the liquid fuel will be exceeded at the nozzle 10, the auxiliary burner 24 will be energized as necessary during continuing operation to insure that the proper temperature of the gas is maintained in conduit 14.

Burner 24 is connected to a suitable fuel supply (not shown) by way of conduit 25 and valve 26. If space is at a premium, it will be understood that chamber 16 may be eliminated and burner 24 may be located directly in conduit 14. It should be noted that auxiliary burner 24 need not be of special design, since it discharges to essentially atmospheric pressure.

The present invention may be readily adapted to dual fuel use which is desirable where certain fuels may become scarce during certain seasons of the year. For example, during most of the year it may be preferred to burn a natural gas-air mixture at burners 2. However, during some seasons and in certain geographical locations, natural gas supplies may become critical andd it would be desirable to be able to easily shift to a liquid fuel oil supply, without shutdown of the oven.

One such dual fuel system is shown in the drawing. The system includes a gas-air injection system including a conduit 28 having a shut-off valve 30 which communicates with conduit 8 between manifold 6 and nozzle 10. A combustible natural gas mixture is formed at 32 by any suitable apparatus familiar to those skilled in the art and the mixture is led through conduit 28, conduit 8 and manifold 6 to the burners 2.

A valve 34 is located in conduit 8 between conduit 28 and nozzle 10 so that the liquid fuel system previously described may be isolated and inactivated when the natural gas-air mixture is being burned. In addition, a by-pass conduit 36, having a valve 38, communicates between the enclosure 1 and conduit 8 at location between valve 34 and conduit 14. The purpose of the by-pass conduit is to preheat the liquid fuel system prior to changover from natural gas to liquid fuel.

It is believed that the foregoing description of the system of the present invention is sufficient to understand the operation of the invention. However, the operation will be briefly described as follows.

The system may be initially lit off on either the natural gas or liquid fuel systems, the latter utilizing burner 24, as previously described.

It will first be assumed for further description of the operation that light off has been completed, that enclosure 1 has reached its desired temperature, and that the burners 2 are in operation and burning a mixture of natural gas and air. In this condition, valves 12, 13' and 34 are closed and valve 30 is opened. Gas and air are mixed at 32 in quantities sufficient to form a combustible mixture and that mixture is conducted under pressure through conduit 28, open valve 30, conduit 8 and manifold 6 to the burners 2 where it is burned.

It will now be assumed that it is desired to shift from natural gas operation to liquid fuel. Prior to shifting, valves 22 and 38 are opened and blower 20 is energized. The blower 20 will draw gases which are already heated by the still functioning natural gas system from enclosure 1 through aperture 18, chamber 16 and valve 22 and will discharge these heated gases into the nozzle area of conduit 8 and through open valve 38 and conduit 36 back to the enclosure. These heated gases will preheat conduit 14 and its blower 20 and the atomizing section of conduit 8 of the liquid fuel system in preparation for changeover.

After a few minutes, valves 30 and 38 are shut and valves 12, 13' and 34 opened. In this condition, liquid fuel from fuel line 11 will now be atomized at nozzle 10, instantaneously vaporized by the heated gases from conduit 14, and mixed with a sufficient quantity of the gases under pressure from blower 20 to form a combustible mixture which passes through conduit 8 and manifold 6 to the burners 2 where it is burned.

Changeover from liquid fuel operation to natural gas is essentially the reverse of the operation just described. To changeover to gas, valves 12, 13' and 34 are shut and valve 30 is opened.

It will be seen from the above description that the present invention is quite economical, since the oxidizing gases which are used to form the combustible mixture are gases which have already been heated by waste heat from the system. Moreover, the need for elaborate, cumbersome, expensive and space consuming equipment is minimized and possible safety hazards are avoided. It will be seen that the system is easily capable of utilizing dual fuels of differing nature and changeover may be accomplished without placing the equipment out of operation and without changing burners, and infrared burners may be used with the liquid fuels which could not otherwise be used with such fuels. Moreover, the present invention is capable of easy retrofit on existing installations.

It will be understood that the embodiment of the present invention which has been described is merely illustrative of one of the applications of the principles of the invention. Numerous modifications may be made by those skilled in the art without departing from the true spirit and scope of the invention.

What is claimed is:

1. A combustion system adapted to heat an enclosure, said system comprising:

combustion burner means for supplying heat to said enclosure, first conduit means connected to said burner means for supplying a combustible mixture of an oxidizing gas and fuel to said burner means, injection means for discharging finely atomized liquid fuel to said first conduit means, second conduit means between said enclosure and said first conduit means for supplying heated oxidizing gas from said enclosure to said first conduit means adjacent said injection means, control means for controlling the temperature and quantity of the oxidizing gas supplied from said second conduit means such that the oxidizing gas vaporizes the liquid fuel atomized by the injection means and forms said combustible mixture, and heating means for supplying additional heat to the gas passing from said enclosure to said second conduit means.

2. The system of claim 1 wherein said control means includes said heating means.

3. The system of claim 1 wherein said control means includes valve means in said second conduit means for controlling the quantity of gas passing through said second conduit.

4. The system of claim 1, wherein said heating means comprises at least one combustion burner.

5. The system of claim 1 wherein said combustion burner means comprise infrared burners.

6. The system of claim 1 including pumping means in said second conduit means.

7. A combustion system adapted to heat an enclosure, said system comprising:

combustion burner means for supplying heat to said enclosure, first conduit means connected to said burner means for supplying a combustible mixture of an oxidizing gas and fuel to said burner means, injection means for discharging finely atomized liquid fuel to said first conduit means, second conduit means between said enclosure and said first conduit means for supplying heated oxidizing gas from said enclosure to said first conduit means adjacent said injection means, first control means for controlling the temperature and quantity of the oxidizing gas supplied from said second conduit means such that the oxidizing gas vaporizes the liquid fuel atomized by the injection means and forms said combustible mixture, second injection means for injecting a combustible mixture of a second fuel and an oxidizing gas into said first conduit means, and second control means for selectively supplying either the combustible mixture of the first mentioned fuel or the second mentioned fuel to the burner means.

8. The system of claim 7 including pumping means in said second conduit means, wherein said control means includes valve means in said second conduit means for controlling the quantity of gas passing through said second conduit and at least one combustion burner means for supplying additional heat to the gas passing from said enclosure to said second conduit means.

9. The system of claim 7 wherein said second injection means injects said combustible mixture into said first conduit means between the first mentioned injection means and said burner means.

10. The system of claim 7 including third conduit means for supplying heated gas from said enclosure through said second conduit when said second mentioned fuel is being supplied to said burner means.

11. The system of claim 8 including third conduit means for supplying heated gas from said enclosure to said second conduit when said second mentioned fuel is being supplied to said burner means.

12. A method of heating an enclosure comprising the steps of:

elevating the temperature of the enclosure, forming an atomized liquid fuel, removing a portion of an oxidizing gas from said heated enclosure, contacting said atomized liquid fuel with said heated oxidizing gas, said oxidizing gas being further heated before contact with said atomized liquid fuel, controlling the quantity and temperature of the gas removed from said enclosure so as to form a combustible mixture with said fuel and vaporize said atomized liquid fuel, and burning said combustible mixture to heat said enclosure.

13. The method of claim 12 wherein said oxidizing gas is air.

* * * * *